US009193363B2

(12) United States Patent
Wiley

(10) Patent No.: US 9,193,363 B2
(45) Date of Patent: Nov. 24, 2015

(54) BALLAST FOR LOCOMOTIVES

(71) Applicant: Progress Rail Services Corporation, Albertville, AL (US)

(72) Inventor: Stephen M. Wiley, Peoria, IL (US)

(73) Assignee: Progress Rail Services Corporation, Albertville, AL (US)

( * ) Notice: Subject to any disclaimer, the term of this patent is extended or adjusted under 35 U.S.C. 154(b) by 267 days.

(21) Appl. No.: 13/890,383

(22) Filed: May 9, 2013

(65) Prior Publication Data

US 2014/0331890 A1 Nov. 13, 2014

(51) Int. Cl.
*B61C 17/00* (2006.01)

(52) U.S. Cl.
CPC ..... *B61C 17/00* (2013.01)

(58) Field of Classification Search
CPC ..... B65D 2519/00796; B61C 17/00
USPC ..... 105/26.05, 73, 75
See application file for complete search history.

(56) References Cited

U.S. PATENT DOCUMENTS

| | | | | |
|---|---|---|---|---|
| 4,094,534 | A | 6/1978 | Welke et al. | |
| 6,352,035 | B1 * | 3/2002 | Kashiwase et al. | 105/72.2 |
| 2011/0303683 | A1 * | 12/2011 | Cowie et al. | 220/636 |

FOREIGN PATENT DOCUMENTS

| | | |
|---|---|---|
| WO | 2011043966 | 4/2011 |

* cited by examiner

*Primary Examiner* — Mark Le
(74) *Attorney, Agent, or Firm* — Miller, Matthias & Hull LLP

(57) ABSTRACT

A ballast is configured to be selectively coupled to a chassis of a locomotive based on an anticipated change in axle load capacity of a rail. The ballast includes a container, a lid, and a catch plate. The container includes one or more sides and is configured to store a heavy mass of material therein. The lid is disposed on one of a bottom and lateral sides of the container. The catch plate is spaced apart and rigidly attached to the container to define a pocket therebetween. The pockets are configured to allow one or more lifting implements to be inserted such that the container may be hoisted and selectively coupled to the chassis.

19 Claims, 5 Drawing Sheets

BALLAST FOR LOCOMOTIVES

TECHNICAL FIELD

The present disclosure relates to a locomotive, and more particularly to a ballast for a locomotive configured to run on rails of varying axle load capacities.

BACKGROUND

Axle load capacities of rails vary from one rail to another. A first rail may be able to withstand a heavy axle load of a locomotive while a second rail may be able to withstand a lighter axle load as compared to the first rail. Typically, locomotives may be of different gross weights and may vary from manufacturer to manufacturer. However, these gross weights must comply with the rail capacities at all instants of time. In order to do so, each axle of the locomotive may need to comply with the axle load capacity requirements of the rail. Several methods previously known in the art accomplish adjustments to the gross weight of the locomotives. However, these previously know methods are typically permanent in nature and may not be adjustable after initial manufacture of the respective structures. Further, any adjustment to a weight of the locomotive while in service may be tedious and cumbersome.

SUMMARY

In one aspect, the present disclosure provides a ballast configured to be selectively coupled to a chassis of a locomotive based on an anticipated change in axle load capacity of a rail. The ballast includes a container, a lid, and a catch plate. The container includes one or more sides and is configured to store a heavy mass of material therein. The lid is disposed on one of a bottom and lateral sides of the container. The catch plate is spaced apart and rigidly attached to the container to define a pocket therebetween. The pockets are configured to allow one or more lifting implements to be inserted such that the container may be hoisted and selectively coupled to the chassis.

In another aspect, the present disclosure provides a locomotive configured to run on a rail. The locomotive includes two or more axles, a chassis disposed on the axles, and one or more ballasts selectively coupled to the chassis based on an anticipated change in axle load capacity of the rail. The ballast includes a container, a lid, and a catch plate. The container includes one or more sides and is configured to store a heavy mass of material therein. The lid is disposed on one of a bottom and lateral sides of the container. The catch plate is spaced apart and rigidly attached to the container to define a pocket therebetween. The pockets are configured to allow one or more lifting implements to be inserted such that the container may be hoisted and selectively coupled to the chassis.

Other features and aspects of this disclosure will be apparent from the following description and the accompanying drawings.

DETAILED DESCRIPTION

Figure 1:
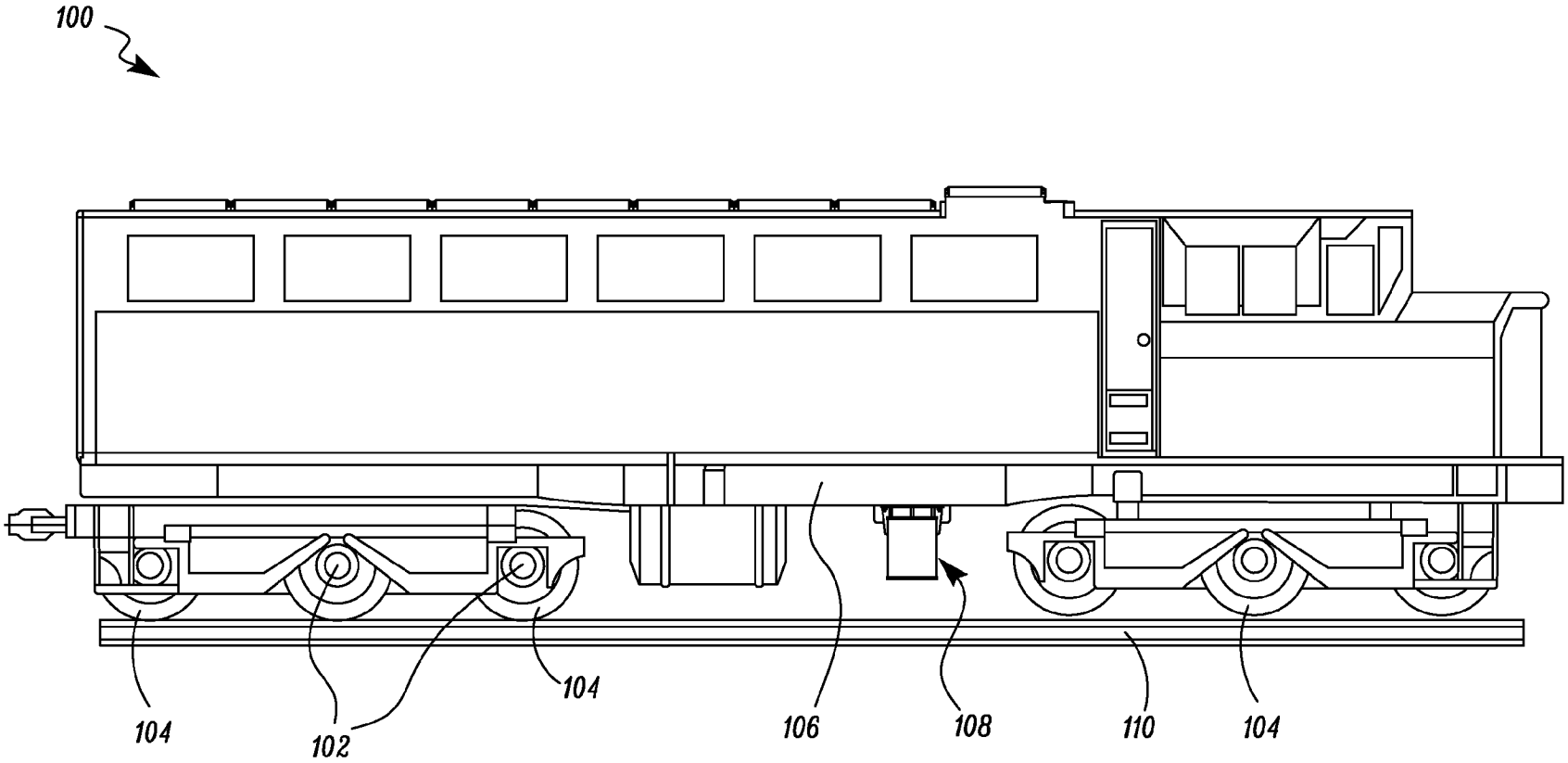
FIG. 1 is a side view of a locomotive in accordance with an embodiment of the present disclosure.

The present disclosure relates to a locomotive configured to run on rails of varying axle load capacities. FIG. 1 shows a side view of the locomotive 100 in which disclosed embodiments may be implemented. In an embodiment, the locomotive 100 may be an industrial locomotive configured to pull cargo containers (not shown). In another embodiment, the locomotive 100 may be a commercial locomotive configured to pull passenger cars (not shown).

The locomotive 100 includes two or more axles 102. In an embodiment as shown in FIG. 1, the locomotive 100 may include six axles 102 associated with wheels 104. The locomotive 100 may further include a chassis 106 disposed on the axles 102. The locomotive 100 includes one or more ballast 108 selectively coupled to the chassis 106 based on an anticipated change in axle load capacity of the rail 110.

Figure 2:
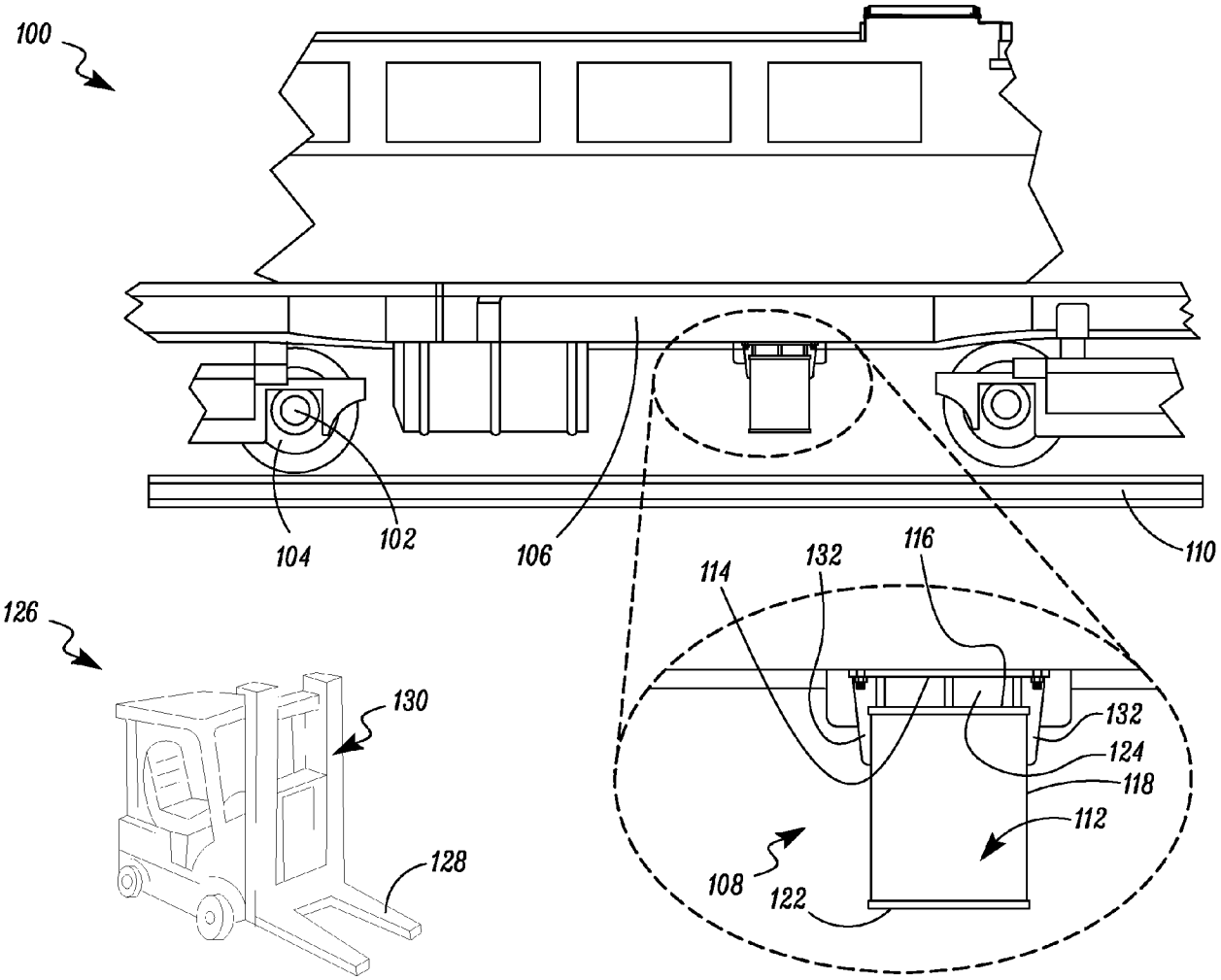
FIG. 2 is a breakaway side view of the locomotive showing a ballast.

In an embodiment as shown in FIG. 2, the ballast 108 includes a container 112, and a catch plate 114. The container 112 includes one or more sides 116, 118, and 122. The container is configured to store a heavy mass of material therein. In one embodiment, the container 112 is box-shaped including a top side 116, lateral sides 118, and a bottom side 122. The catch plate 114 is spaced apart and rigidly attached to the container 112 to define at least one pocket 124 therebetween. The pockets 124 are configured to allow one or more lifting implements 126 to be inserted such that the container 112 may be hoisted and selectively coupled to the chassis 106.

In an exemplary embodiment as shown in FIG. 2, the pockets 124 defined between the catch plate 114 and the container 112 may be a pair of hollow square passages. The lifting implements 126, for example, forks 128 of a forklift machine 130, may be inserted into the hollow square passages and raised to a height above a ground surface such that the ballast 108 may be hoisted. Further, the forklift 130 may transport and position the ballast 108 under the chassis 106 for coupling with the chassis 106. Although in the preceding embodiment, it is disclosed that the pockets 124 may be hollow square passages, it is to be noted that, any shape of the pockets 124 commonly known in the art may be employed depending on the type of lifting implements 126 used to hoist and support the container 112 by lifting the catch plate 114. Further, in various embodiments, a configuration of the pockets 124, the catch plate 114, and the container 112 impart or render the ballast with a lower center of gravity. This lower center of gravity in the ballast 108 may configure the ballast 108 to remain stable while transporting it using the forklift machine 130.

In an embodiment as shown in FIG. 2, the ballast 108 includes one or more webbings 132 rigidly attached to the catch plate 114 and one or more of the top and lateral sides 116, 118 of the container 112. The webbings 132 impart rigidity and structural strength to the ballast 108 in handling forces experienced during hoisting and coupling the ballast 108 to the chassis 106. Further, the webbings 132 are configured to handle a weight of the ballast 108 when suspended from the chassis 106 upon coupling of the catch plate 114 thereon.

Figure 3:
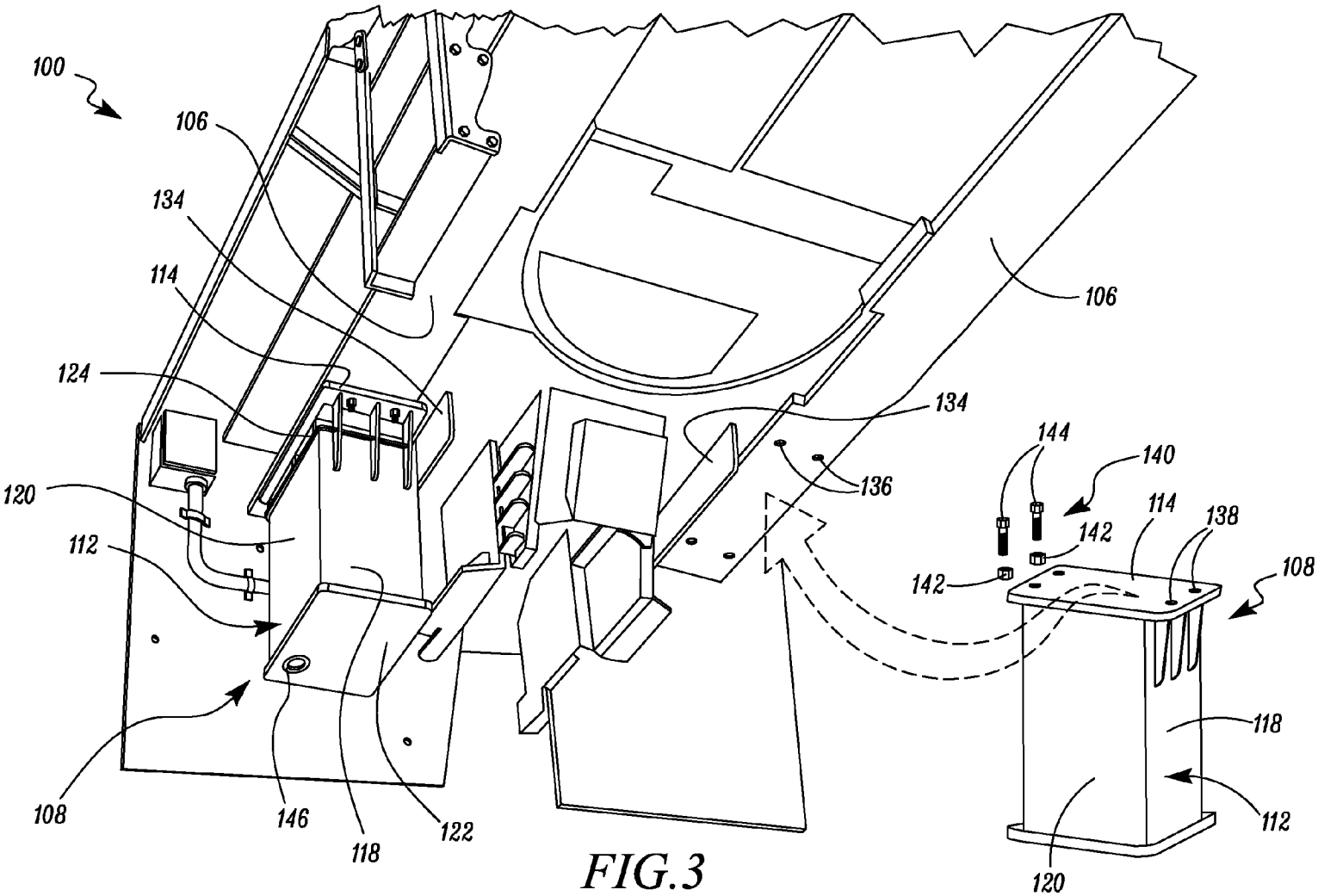
FIG. 3 is a view of an underside of the locomotive showing the ballast.

In an embodiment as shown in FIG. 3, the ballast 108 further includes a stop plate 134 which may be rigidly attached on a backside 120 of the container 112 or may be rigidly attached to the chassis 106 of the locomotive 100. In one embodiment, the stop plate 134 may be rigidly attached to the chassis 106 and disposed behind the pockets 124 of the ballast 108. The stop plate 134 is configured to close the pockets 124 from the backside 120 and act as a stopping mechanism to the lifting implements 126 from travelling deep underneath the locomotive 100 and damaging other equipment when the ballast 108 is positioned under the chassis 106 during while coupling.

In an embodiment as shown in FIG. 3, the chassis 106 and the catch plate 114 define one or more openings 136, 138 thereon. These openings 136, 138 are configured to allow fasteners 140 therein and releasably fasten the catch plate 114 to the chassis 106. Fastening the catch plate 114 to the chassis 106 thus accomplishes a coupling of the ballast 108 to the locomotive 100. In the exemplary embodiment as shown in FIG. 3, the fasteners 140 may be threaded fasteners such as nuts 142, and bolts 144. However, the fasteners 140 disclosed herein are merely exemplary in nature and hence, non-limiting of this disclosure. Any type of fasteners 140 or interlocking geometry commonly known in the art may be employed between the ballast 108 and the chassis 106 to releasably couple the catch plate 114 to the chassis 106 of the locomotive 100.

As shown in FIG. 3, the ballast 108 further includes a lid 146 on one of the bottom and lateral sides 122, 118 of the container 112. In the exemplary embodiment of FIG. 3, the lid 146 is disposed on the bottom side 122 of the container 112. However, in alternative embodiments, the lid 146 may be disposed on any one of the lateral sides 118 of the container 112. The lid 146 can be opened and closed to allow filling or removal of material into and out of the container 112. Before initiating filling of material into the ballast 108, the catch plate 114 may be rested on the ground surface to keep the ballast 108 in an inverted position. The lid 146 on the bottom side 122 may be opened to pour material such as, but not limited to, molten metal or liquid concrete into the container 112, impart mass to the ballast 108 and thereby increase a weight of the ballast 108. In an alternative embodiment, materials in solid state and form such as, but not limited to, lead pellets or sand, may also be filled in place of liquid material to increase the weight of the ballast 108.

Figure 4:
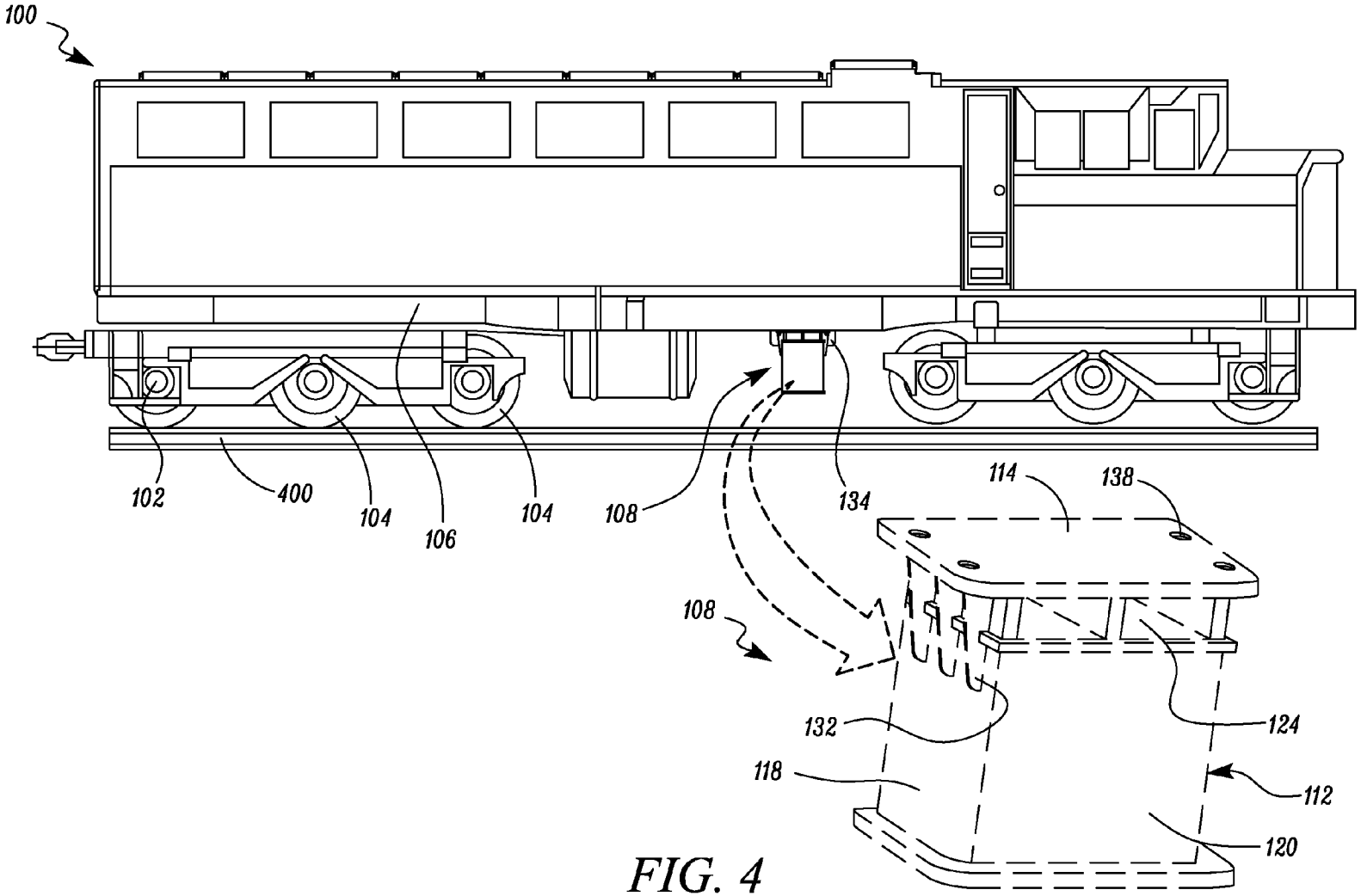
FIGS. 4-5 illustrate a side view of the locomotive and a rail in accordance with various embodiments of the present disclosure.
Figure 5:
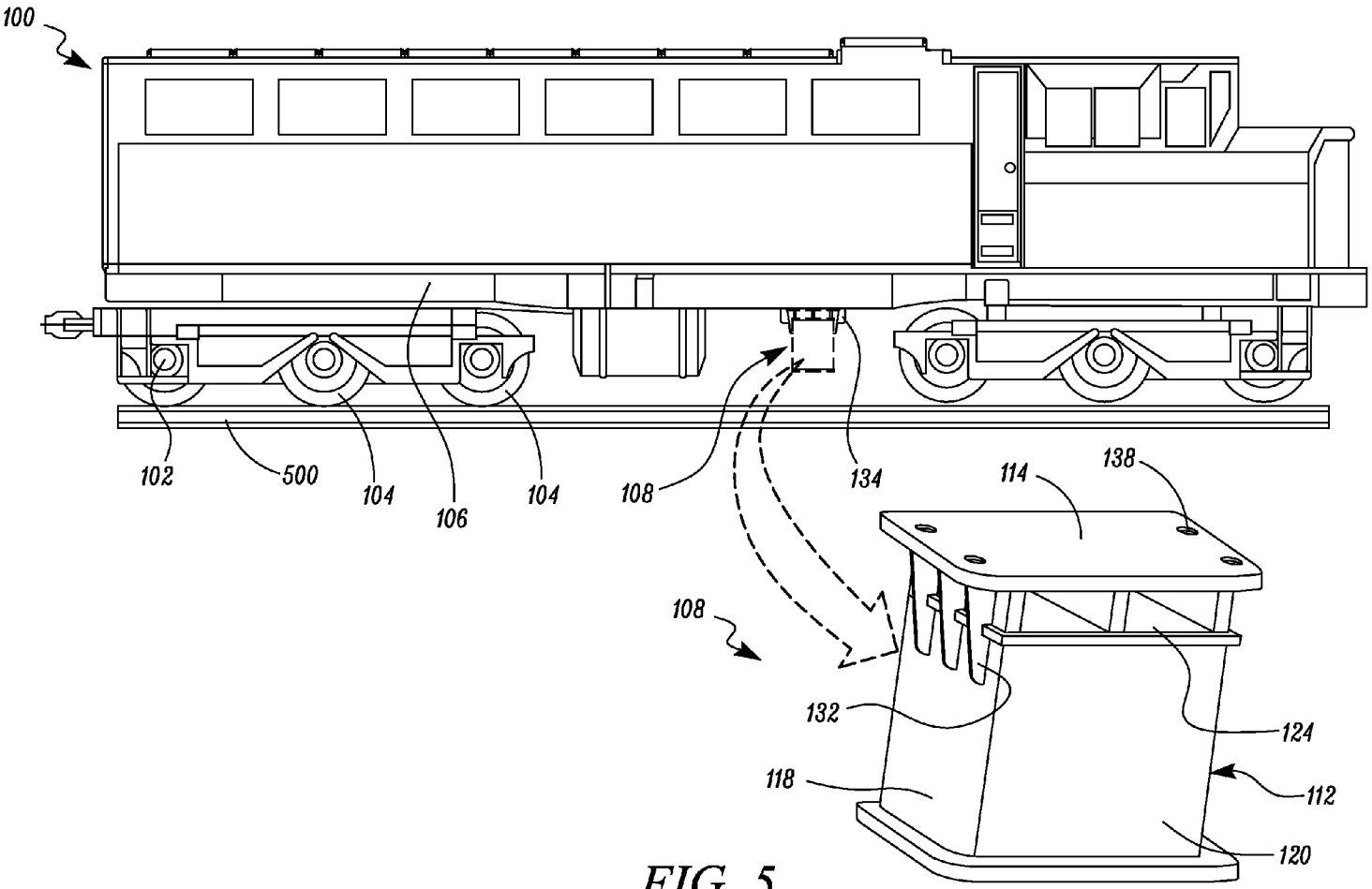

For the purposes of understanding the various embodiments of the present disclosure, a rail 400 of heavy axle load capacity is shown in FIG. 4, and a rail 500 of light axle load capacity is shown in FIG. 5 respectively. In one embodiment, the locomotive 100 may move from the rail 400 of heavy axle load capacity to the rail 500 of light axle load capacity. In another embodiment, the locomotive 100 may move from the rail 500 of light axle load capacity to the rail 400 of heavy axle load capacity. Subsequent monitoring of the axle loads by the selective coupling of the ballast 108 onto the chassis 106 of the locomotive 100 when the locomotive 100 moves from the rail 400 to the rail 500 and vice-versa will be explained in the appended disclosure.

In an embodiment as shown in FIG. 4, the locomotive 100 may be running on the rail 400 of heavy axle load capacity prior to moving onto the rail 500 of lighter axle load capacity of FIG. 4. In the preceding embodiment, the ballast 108 may be decoupled from the chassis 106 based on an anticipated decrease in the axle load capacity from rail 400 to rail 500. Decoupling of the ballast 108 may decrease an overall weight of the locomotive 100 thereby decreasing the axle load on each axle 102 of the locomotive 100.

In another embodiment as shown in FIG. 5, the locomotive 100 may run on the rail 500 of light axle load capacity before moving onto the rail 400 of heavy axle load capacity of FIG. 4. In the preceding embodiment, the ballast 108 is coupled to the chassis 106 of the locomotive 100 based on an anticipated increase in the axle load capacity from rail 500 to rail 400. Coupling the ballast 108 to the chassis 106 may increase the overall weight of the locomotive 100 thereby increasing the axle load on each axle 102 of the locomotive 100.

As evident from the disclosure pertaining to FIGS. 4-5, the ballast 108 may be coupled or decoupled from the locomotive 100 to impart or remove a second weight to a first unladen weight of the locomotive 100. Therefore, with specific reference to the locomotive 100 shown in FIG. 5, the overall weight of the locomotive 100 is a sum of the first unladen weight, and the second weight from the coupled ballast 108. However, with specific reference to the locomotive 100 shown in FIG. 4, the overall weight of the locomotive 100 is the first unladen weight of the locomotive 100 alone; since the ballast 108 is decoupled the locomotive 100 and the locomotive 100 travels without the ballast 108 thereon.

In an embodiment, the axle load capacity of the rail 400/500 may be defined by a range from a maximum axle load capacity to a minimum axle load capacity. Therefore, in various embodiments disclosed herein, the second weight of the ballasts 108 may be implemented such that the axle load of the locomotive 100 lies between the maximum and minimum axle load capacity of the rail 400/500.

Therefore, in this embodiment, the second weight of the ballasts 108 may be determined based on the axle load capacity of the rail 400/500 and the first unladen weight of the locomotive 100. A person having ordinary skill in the art may acknowledge that the second weight of the ballasts 108 may depend on a mass of material being filled into the container 112. Thus, determining a specific mass of material to fill the container 112 may be done by co-relating the first unladen weight of the locomotive 100 and the axle load capacity of the rail 400/500. By co-relating and determining a weight of the ballast 108, the ballast 108 may be configured to maintain the axle loads of the locomotive 100 between the maximum and minimum axle load capacity of the rails 400/500 when coupled to the locomotive 100.

INDUSTRIAL APPLICABILITY

Axle load capacities of rails vary from one rail to another. A first rail may be able to withstand a heavy axle load of a locomotive while a second rail may be able to withstand a lighter axle load as compared to the first rail. However, each axle of the locomotive may need to confirm to the axle load capacity requirements of the rail at all instants of time.

Typically, industrial locomotives used to pull cargo containers may comply with different axle load capacities of one or more rails by involving a transfer of contents from larger cargo containers to smaller containers or vice-versa such that the axle loads associated with the containers comply with the anticipated axle load capacity of the onward rail. However, the axle load on each axle of the locomotive may still remain unchanged and hence be non-compliant with the axle load capacity of the rail.

The axle loads on the axles of the locomotive also manifest themselves as an influence on adhesive force between wheels of the locomotive and the rail to improve a tractive effort of the locomotive. When individual axle loads of the locomotive are lesser than the minimum axle load capacity of the rail, insufficient adhesion and traction may occur between the wheels and the rail. Consequently, the wheels of the respective axles may slip on the rail causing difficulty in hauling the containers. Conversely, when individual axle loads of the locomotive exceed the maximum axle load capacity of the rail, the rail may be subject to one or more negative or detrimental effects such as premature failure.

In the locomotive 100 of the present disclosure, the axle loads may be varied by selectively coupling the ballasts 108 to the chassis 106. Further, when manufacturing the ballast 108 and adding a mass of material therein, a weight of the ballast 108 is determined and selected beforehand such that a number of such ballasts 108 may be coupled to the locomotive 100 to make the individual axle load compliant of the locomotive 100 with the anticipated axle load capacity of the onward rail 400/500.

In alternative embodiments, the ballasts 108 also may be of different weights such that a combination of ballasts 108 may be coupled or decoupled from the locomotive 100 to achieve a finer degree of control in maintaining the overall weight of the locomotive 100. The finer degree of control may be helpful in cases where the axle load capacity of the rail 400/500 is defined by the maximum and minimum axle load capacity respectively. Further, the ballasts 108 of different weights may be used to adjust the mass across a front to a rear, and from side to side of the locomotive 100. In this manner, a weight of the locomotive 100 may be equally balanced on all sides.

Coupling or de-coupling of the ballasts 108 onto the locomotives 100 may be performed by an operator at train stations or any suitable locomotive 100 yard. Further, lifting implements 126 such as the forklift 130 or any other type of lifting implements 126 commonly known in the art may be used to hoist, transport, and position the ballasts 108 beneath the locomotive 100 for coupling with the chassis 106. Thus, an operator may easily and conveniently use the ballasts 108 disclosed herein to vary the individual axle loads of the locomotive 100 based on changes in the axle load capacities of the rails 400/500.

Conventional locomotives are known to have one or more fluid lines running along an underside of the locomotive. These fluid lines are for example, but not limited to, brake lines, oil lines and the like. In addition, other equipment such as brake control racks and electrical cables may be located along the underside of the locomotive 100. The stop plate 134 at the backside 120 of the ballast 108 disclosed herein may prevent any lifting implements 126 from going too far on the underside of the locomotive 100 and damaging the fluid lines or other equipment. Thus, when a forklift 130 is used to hoist and position the ballast 108 beneath the chassis 106, the forks 128 may be stopped by the stop plate 134 from penetrating too far and damaging the fluid lines or other equipment. Therefore, a possibility of damage to components mounted beneath the chassis 106 is mitigated.

While aspects of the present disclosure have been particularly shown and described with reference to the embodiments above, it will be understood by those skilled in the art that various additional embodiments may be contemplated by the modification of the disclosed machine, systems and methods without departing from the spirit and scope of what is disclosed. Such embodiments should be understood to fall within the scope of the present disclosure as determined based upon the claims and any equivalents thereof.

I claim:

1. A ballast configured to be selectively coupled to an underside of a chassis of a locomotive based on an anticipated change in axle load capacity of a rail, the ballast comprising:

a container including one or more sides, the container storing a heavy mass of material, wherein the weight of the heavy mass of material is provided based on the anticipated change in the axle load capacity of the rail;

a lid disposed on one of a bottom and lateral sides of the container; and a catch plate disposed above, spaced apart and rigidly attached to the container to define at least one pocket therebetween above a top side of the container, the at least one pocket configured to allow one or more lifting implements to be inserted such that the ballast may be hoisted by the catch plate and the catch plate of the ballast selectively coupled to the underside of the chassis.

2. The ballast of claim 1, wherein the container is box-shaped.

3. The ballast of claim 1, wherein the lid is configured to be opened and closed to allow filling or removal of material into and out of the container.

4. The ballast of claim 1 further including one or more webbings rigidly attached to the catch plate and one or more of a top side and the lateral sides of the container.

5. The ballast of claim 1, wherein the catch plate defines one or more openings thereon, the openings configured to allow fasteners therein and releasably fasten the catch plate to the underside of the chassis.

6. The ballast of claim 1, wherein the ballast is configured to be coupled to the underside of the chassis of the locomotive based on an anticipated increase in the axle load capacity of the rail.

7. The ballast of claim 1, wherein the ballast is configured to be decoupled from the underside of the chassis of the locomotive based on an anticipated decrease in the axle load capacity of the rail.

8. The ballast of claim 1, wherein the ballast is configured to be selectively coupled to the underside of the chassis of the locomotive such that an axle load of the locomotive lies between a maximum and minimum axle load capacity of the rail.

9. The ballast of claim 8, wherein a weight of the ballast is determined based on the axle load capacity of the rail and an unladen weight of the locomotive.

10. A locomotive configured to run on a rail, the locomotive including:

two or more axles;

a chassis disposed on the axles and having an underside;

one or more ballasts selectively coupled to the underside of the chassis based on an anticipated change in axle load capacity of the rail, the ballast including:

a container including one or more sides, the container configured to store a heavy mass of material;

a lid disposed on one of a bottom and lateral sides of the container; and a catch plate disposed above, spaced apart and rigidly attached to the container to define at least one pocket therebetween above a top side of the container, the at least one pocket configured to allow one or more lifting implements to be inserted such that the ballast may be hoisted by the catch plate and the catch plate of the ballast selectively coupled to the underside of the chassis.

11. The locomotive of claim 10, wherein the container is box shaped.

12. The locomotive of claim 10, wherein the lid is configured to be opened and closed to allow filling or removal of material into and out of the container.

13. The locomotive of claim 10 further including one or more webbings rigidly attached to the catch plate and one or more of a top side and the lateral sides of the container.

14. The locomotive of claim 10 further including a stop plate rigidly attached to the underside of the chassis and disposed behind the pockets of the ballast and positioned to stop the ballast from travelling deep underneath the locomotive when the ballast is positioned under the chassis during coupling.

15. The locomotive of claim 10, wherein the chassis and the catch plate define one or more openings thereon, the openings configured to allow fasteners therein and releasably fasten the catch plate to the chassis.

16. The locomotive of claim 10, wherein the ballast is coupled to the underside of the chassis of the locomotive based on an anticipated increase in the axle load capacity of the rail.

17. The locomotive of claim 10, wherein the ballast is decoupled from the underside of the chassis of the locomotive based on an anticipated decrease in the axle load capacity of the rail.

18. The locomotive of claim 10, wherein the ballast is configured to be selectively coupled to the underside of the chassis of the locomotive such that an axle load of the locomotive lies between a maximum and minimum axle load capacity of the rail.

19. The locomotive of claim 18, wherein a weight of the ballast is determined based on the axle load capacity of the rail and an unladen weight of the locomotive.

* * * * *